US010383469B2

(12) United States Patent
Iliev

(10) Patent No.: US 10,383,469 B2
(45) Date of Patent: Aug. 20, 2019

(54) INERTIA AND GRAVITY DRIVEN COLLAPSIBLE GARMENT HANGER

(71) Applicant: Peter Simeonov Iliev, Birmingham, AL (US)

(72) Inventor: Peter Simeonov Iliev, Birmingham, AL (US)

( * ) Notice: Subject to any disclaimer, the term of this patent is extended or adjusted under 35 U.S.C. 154(b) by 14 days.

(21) Appl. No.: 15/643,204

(22) Filed: Jul. 6, 2017

(65) Prior Publication Data

US 2017/0303718 A1 Oct. 26, 2017

Related U.S. Application Data

(63) Continuation-in-part of application No. PCT/IB2016/050027, filed on Jan. 5, 2016.

(60) Provisional application No. 62/100,381, filed on Jan. 6, 2015.

(51) Int. Cl.
*A47G 25/40* (2006.01)

(52) U.S. Cl.
CPC ..... *A47G 25/4023* (2013.01); *A47G 25/40* (2013.01)

(58) Field of Classification Search
CPC ..... A47G 25/40; A47G 25/4015; A47G 25/4023; A47G 25/4046; A47G 2025/4092
See application file for complete search history.

(56) References Cited

U.S. PATENT DOCUMENTS 2,137,700 A 11/1938 Reehl
2,723,065 A * 11/1955 Vargo ..... A47G 25/4023 223/94
2,728,499 A * 12/1955 Mueller ..... A47G 25/4023 223/94
4,117,960 A 10/1978 Bengsch
4,231,499 A 11/1980 Smith
4,609,132 A 9/1986 Brokenshire
4,813,581 A 3/1989 Lamont
5,397,037 A * 3/1995 Ozawa ..... A47G 25/4023 223/89
5,590,823 A 1/1997 Ersler
5,979,721 A 11/1999 Curtis
6,540,121 B1 4/2003 Harvey
7,243,823 B2 7/2007 Cresap et al.
7,246,729 B2 7/2007 Harvey
7,828,179 B2 11/2010 Sprovieri
8,523,026 B2 9/2013 Tseng et al.
(Continued)

FOREIGN PATENT DOCUMENTS

GB 593553 A * 10/1947

*Primary Examiner* — Ismael Izaguirre

(57) ABSTRACT

Disclosed is a collapsible garment hanger capable of being operated by one hand. The collapsible garment hanger includes one or more hanger arms, wherein a hanger arm comprises an elongated body. Further, the collapsible garment hanger includes one or more locking mechanisms coupled to the one or more hanger arms. A locking mechanism coupled to a hanger arm is configured to remain in one of a locked state and an unlocked state, wherein a weight of one or more of the hanger arm and the locking mechanism is configured to enable the locking mechanism to change between a locked state and an unlocked state in response to a motion of the hanger arm in relation to the locking mechanism. Moreover, the collapsible garment hanger includes a housing structure coupled to the one or more locking mechanisms.

17 Claims, 10 Drawing Sheets

(56) References Cited

U.S. PATENT DOCUMENTS

| | | | | |
|---|---|---|---|---|
| 8,814,013 | B2 * | 8/2014 | Almeida Levi | A47G 25/40 223/94 |
| 2006/0054646 | A1 * | 3/2006 | Nathanmanna | A47G 25/4023 223/89 |
| 2011/0284597 | A1 * | 11/2011 | Kaleta | A47G 25/4023 223/85 |
| 2012/0018462 | A1 * | 1/2012 | Betts | A47G 25/4023 223/85 |

* cited by examiner

INERTIA AND GRAVITY DRIVEN COLLAPSIBLE GARMENT HANGER

The current application claims priority to the Patent Cooperation Treaty (PCT) application PCT/IB2016/050027 filed on Jan. 5, 2016. The PCT application PCT/IB2016/050027 claims priority to the U.S. Provisional Patent application Ser. No. 62/100,381 filed on Jan. 6, 2015.

FIELD OF THE INVENTION

The present disclosure relates generally to a garment hanger, more particularly, the present disclosure relates to a collapsible garment hanger capable of being operated by one hand.

BACKGROUND OF THE INVENTION

Garment hangers are commonly used to store garments. The hangers prevent garments from getting wrinkled. The most common form of a garment hanger is a steel wire hanger, which is relatively simple in design, but effective in hanging garments while also preventing wrinkles. However, it is sometimes difficult to put these garment hangers inside a garment or remove from the garment. Often, users end stretching the neck of a garment to insert the garment hanger inside the garment. Further, it is difficult to carry the garment hangers, such as in a suitcase.

Therefore, some collapsible garment hangers are available in the market. They can be folded (or collapsed) to easily position the hanger inside a garment or remove it from a garment. Further, it is easier to carry the collapsible garment hangers in a collapsed state. However, a user is required to use their two hands to maneuver the garment hanger and the garment. For the average user, this is inconvenient, but for persons with disabilities, it may make the process of hanging garments very difficult.

Accordingly, there is a present need for a collapsible garment hanger that facilitates the hanging of garments in a faster and more efficient manner.

SUMMARY OF THE INVENTION

This summary is provided to introduce a selection of concepts in a simplified form that are further described below in the Detailed Description. This summary is not intended to identify key features or essential features of the claimed subject matter. Nor is this summary intended to be used to limit the claimed subject matter's scope.

Disclosed is a collapsible garment hanger capable of being operated by one hand. The collapsible garment hanger includes one or more hanger arms, wherein a hanger arm comprises an elongated body. Further, the collapsible garment hanger includes one or more locking mechanisms coupled to the one or more hanger arms. A locking mechanism coupled to a hanger arm is configured to remain in one of a locked state and an unlocked state, wherein a weight of one or more of the hanger arm and the locking mechanism is configured to enable the locking mechanism to change between a locked state and an unlocked state in response to a motion of the hanger arm in relation to the locking mechanism. Moreover, the collapsible garment hanger includes a housing structure coupled to the one or more locking mechanisms.

According to some aspects, an object of the present disclosure is to provide a device that facilitates the hanging of garments, in a faster and more efficient manner. Another object of the present disclosure is to utilize inertia and gravity as a primary means of operation. Yet another object of the present disclosure is to provide at least two distinct modes, or processes, of operation thereby being especially useful to persons with disabilities by giving them the option to choose which mode of operation is best suited for them depending on their disability. The two modes of operation allow hanger arms of the disclosed device to be extended either synchronously or asynchronously and used to support a garment. Furthermore, it is an object of the present disclosure to provide a device and processes for hanging garments which prevent the neck of a garment from stretching. Yet another object of the present disclosure is to provide synchronous and asynchronous, automatic locking of the hanger arms of the disclosed device. Moreover, an object of the present disclosure is to utilize inertia and gravity as the primary means of rotating and locking the arms of the disclosed device. Yet another object of the present disclosure is to provide a device that is adapted to allow single-handed use, without the need for relocation of the palm of the user's hand, relative to the hanger of the disclosed device. The disclosed device facilitates the transition between the locked state and the unlocked state by a force that may be provided with a single hand without availability of a supporting force (e.g. holding of a housing with one hand while moving the hanger arm with another hand; or holding the housing with one hand and restricting the free end of the hanger against another object, such as a wall).

According to some aspects, the disclosed collapsible garment hanger includes a housing structure, two hanger arms, and a locking mechanism.

According to some aspects, the disclosed collapsible garment hanger includes a housing structure, a hanger arm, and a locking mechanism. This design may be cheaper to manufacture and may be more easily operated by the user since only one hanger arm must be collapsed or locked in place.

According to some aspects, the disclosed collapsible garment hanger may be operated via two modes, which may be used to return the hanger arms to an extended position. These modes may be performed by operating the collapsible garment hanger with a single hand, without the need for relocation of the palm of said hand, relative to the collapsible garment hanger. The first mode involves using primarily inertia and gravity for extending and automatically locking the hanger arms asynchronously. In this mode, the hanger arms are collapsed by pressing the button. The user may then insert the hanger into the garment they wish to hang. While holding the housing structure, the hanger is then tilted, jolted, or otherwise rotated to either the left or the right. As the housing structure is rotated to one side, the hanger arm on that side begins to rotate about the arm pivot due to gravity and inertia. The weight of the hanger arm allows it to rotate accordingly. In alternative embodiments, weights may be added to the hanger arms such that they swing more readily in response to the rotation of the housing structure. The housing structure is rotated until the hanger arm engages with its corresponding detent of the locking mechanism. At this point, the housing structure is rotated in the opposite direction until the second hanger arm engages with the other detent. After this, the housing structure is returned to a level position and can be hung in a closet, on a rack, on a line, or in any other suitable location. In an alternative embodiment, the user may rotate, jolt, or fling the housing structure rapidly in one direction such that both hanger arms unfold due to inertia and/or gravity. The hanger can then be returned to a level position. In an alternative embodiment, the user may rotate the housing structure 180 degrees or further such that both hanger arms unfold due to inertia and gravity. The hanger can then be returned to a level position. These alternative embodiments allow for both hanger arms to be locked in place as a result of a single rotation, rather than two rotations in opposite directions.

The second mode of operating the disclosed collapsible garment hanger involves using primarily inertia and gravity for extending and automatically locking the hanger arms synchronously. In this mode, the hanger arms are collapsed by pressing the button. The user may then insert the hanger into the garment they wish to hang. While holding the housing structure, the user imparts one or more forces on the collapsible garment hanger such that inertia causes both hanger arms to swing upwards and into a locked position. The housing structure is moved downward in a swift motion. With this motion, inertia causes the hanger arms to swing outwards such that they lock onto the detents. After this, the housing structure can be hung in a closet, on a rack, on a line, or in any other suitable location. In an alternative embodiment, instead of a downward motion, the hanger is forced upward in a swift motion and brought to an abrupt stop. This abrupt stop causes the inertia of the hanger arms to swing them upwards and into a locked position. In an alternative embodiment, instead of bringing the housing structure to an abrupt stop after the upwards motion, it is forced in a swift downwards motion. This rapid change in movement causes the inertia to continue carrying the hanger arms upwards while the housing structure is moving downwards. It is with this upward inertia that the hanger arms are brought to a locked position.

The disclosed collapsible garment hanger provides following advantages. The collapsible garment hanger utilizes inertia and gravity as its primary means of operation and it can be operated using only one hand. This will not only be beneficial for persons with disabilities, who may not have full mobility of their hands but will also make the process of hanging garments easier for an average user. A single button is provided to easily release the hanger arms of the collapsible garment hanger. The hanger arms can then be extended via two modes. Furthermore, the collapsible garment hanger allows single-handed use without the need for relocation of the palm of the user's hand.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
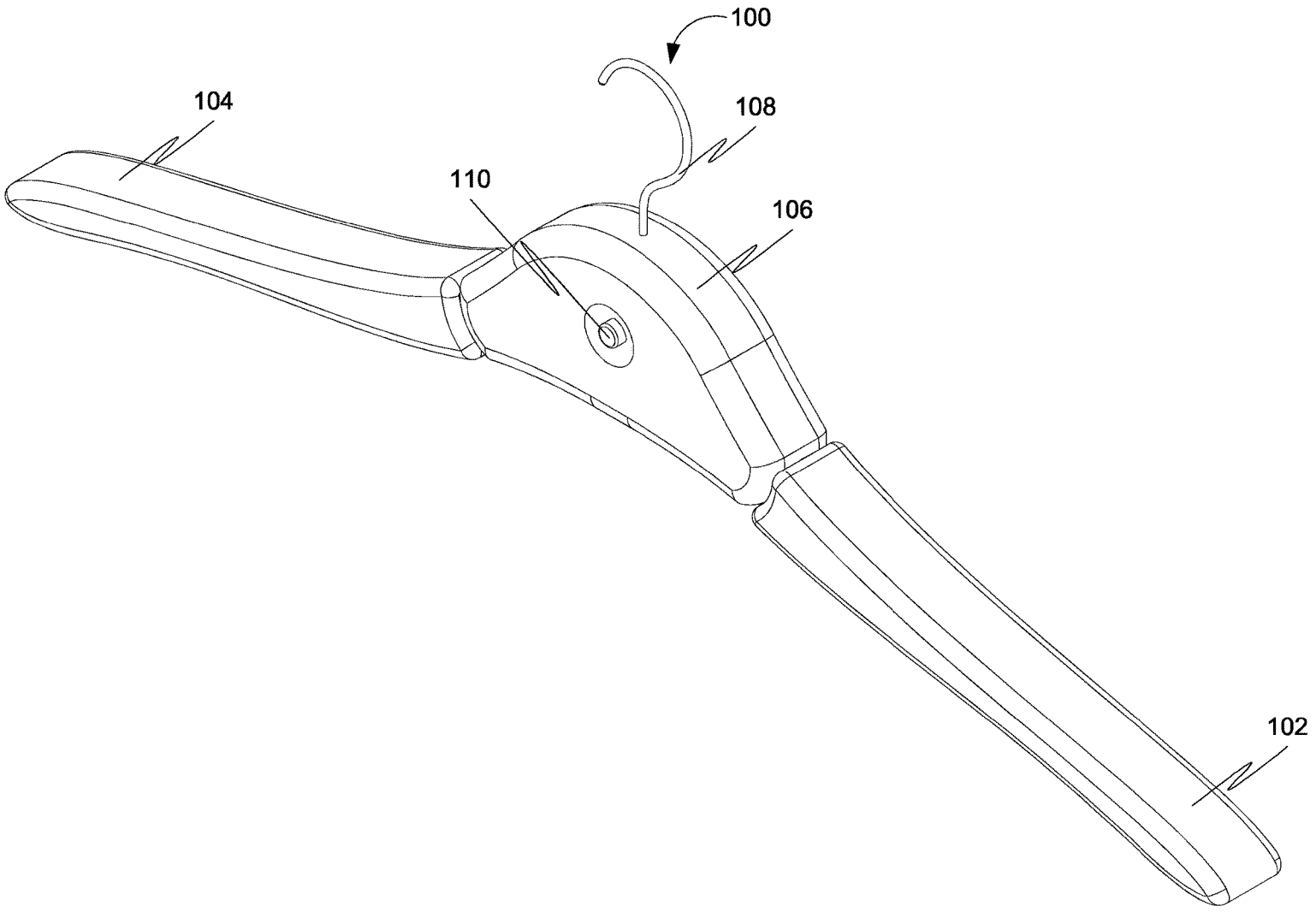
FIG. 1 is a perspective view of a collapsible garment hanger in a locked state in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of garment hangers, embodiments of the present disclosure are not limited to use only in this context.

Referencing to FIG. 1, a perspective view of a collapsible garment hanger 100 is shown in a locked state in accordance with some embodiments. The collapsible garment hanger 100 may be capable of being operated by one hand.

The collapsible garment hanger 100 may include one or more hanger arms 102-104. Each of the hanger arms 102-104 may include an elongated body. Further, the collapsible garment hanger 100 may include a housing structure 106 coupled to one or more locking mechanisms. An exterior surface of the housing structure 106 may include a non-slip material that prevents the collapsible garment hanger 100 from falling out of the user's hand, prevent garments from falling off the collapsible garment hanger 100, and prevents stretching material of the garment by the collapsible garment hanger 100. Further, the one or more locking mechanisms may be coupled to the one or more hanger arms 102-104, wherein a locking mechanism coupled to a hanger arm may be configured to remain in one of a locked state and an unlocked state.

Figure 2:
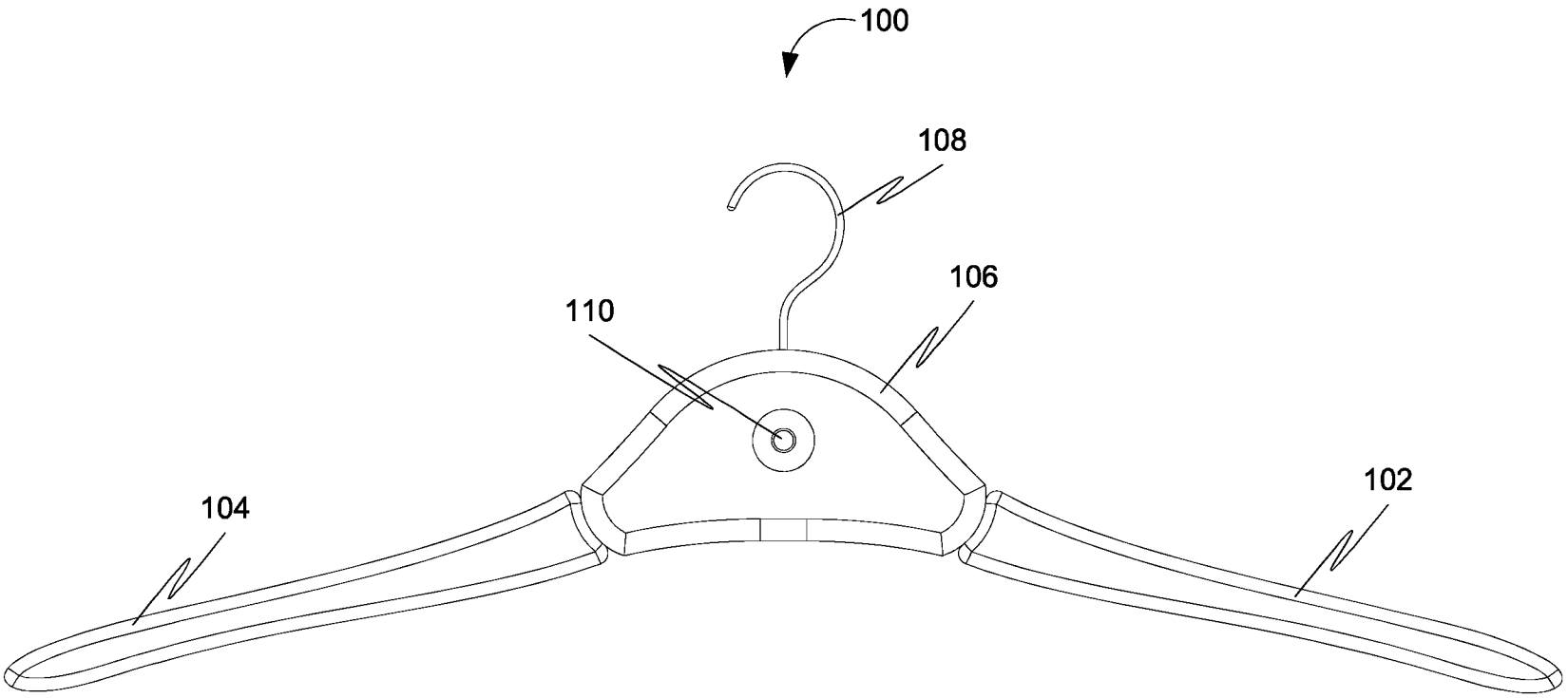
FIG. 2 is a front view of the collapsible garment hanger of FIG. 1 in the locked state.
Figure 3:
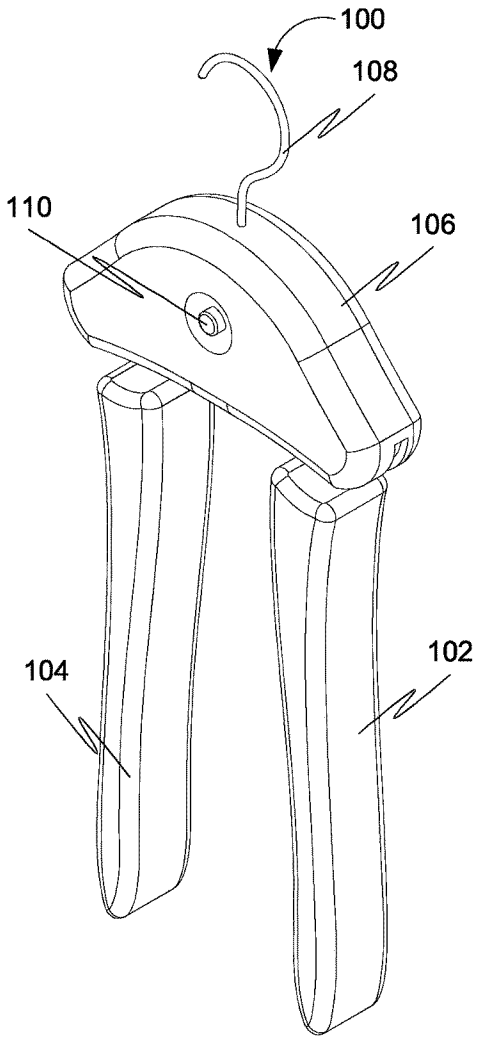
FIG. 3 is a perspective view of the collapsible garment hanger of FIG. 1 in an unlocked state.
Figure 4:
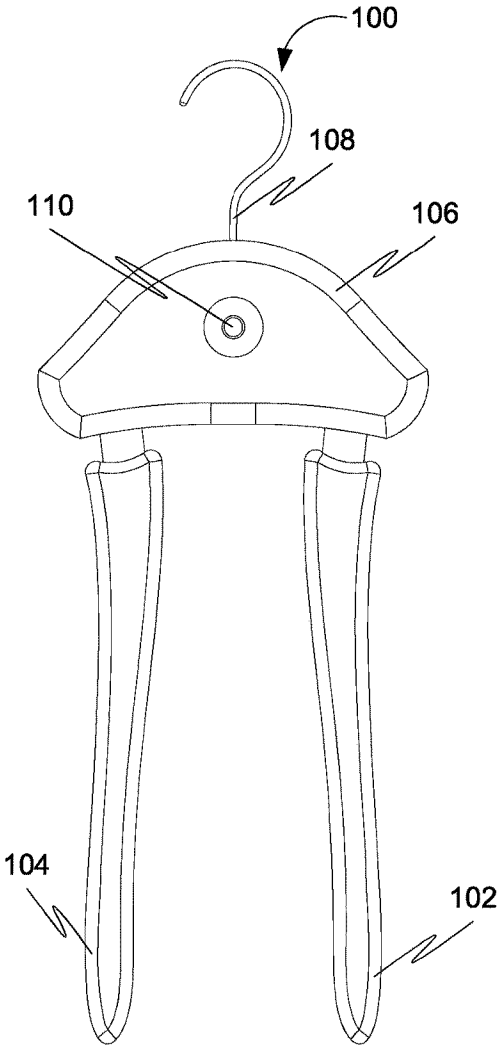
FIG. 4 is a front view of the collapsible garment hanger of FIG. 1 in the unlocked state.

FIG. 2 is a front view of the collapsible garment hanger 100 in the locked state. FIG. 3 is a perspective view of the collapsible garment hanger 100 in an unlocked state. FIG. 4 is a front view of the collapsible garment hanger 100 in the unlocked state.

Yet further, a weight of at least one of the one or more hanger arms 102-104 and the locking mechanism may be configured to enable the locking mechanism to change between a locked state and an unlocked state in response to a motion of the respective hanger arm in relation to the locking mechanism. The motion may include an abrupt motion. Further, the motion may include one or more of a linear motion and a rotatory motion. As an example, in an embodiment, the one or more hanger arms 102-104 may be slidably coupled with the locking mechanism and the user may be required to provide an abrupt linear force on the housing structure 106. Accordingly, an abrupt linear motion of the hanger arm (in the one or more hanger arms 102-104) in relation to the housing structure 106 may ensue. Consequently, a transition between the locked state and the unlocked state may occur. Similarly, in another embodiment, the abrupt motion may be a sudden rotatory motion of the housing structure 106 in relation to the hanger arm (in the one or more hanger arms 102-104). In another exemplary embodiment, a second end of the elongated body of the hanger arm (in the one or more hanger arms 102-104) may comprise a ball configured to rotate within a socket comprised in the locking mechanism. Accordingly, the user may be required to provide a rotatory force (e.g. a sudden turn of the housing structure) in order to transition the locking mechanism between the locked and the unlocked state.

Further, the one or more hanger arms 102-104 may include one or more weight loads disposed proximal to a first end of the elongated body, wherein the locking mechanism is coupled to the one or more hanger arms 102-104 at a second end of the elongated body. Moreover, the one or more hanger arms 102-104 may include one or more weight slots configured to receive the one or more weight loads. Further, the weight may also be placed in the housing structure 106. Accordingly, in some embodiments, a user may determine an amount of weight load to be added in order to operate the collapsible garment hanger 100. Consequently, usability of the collapsible garment hanger 100 may be enhanced by allowing the user to configure the collapsible garment hanger 100 according to their usage. For example, a disabled user may not be able to perform an abrupt motion with an extent required to enable the hanger arm to be moved into the locked position. Accordingly, the user may be allowed to add a plurality of weights in a corresponding plurality of weight slots in order to enable the user to conveniently rotate the housing structure and cause the locking mechanism to be changed into the locked state. As another example, the user may select an amount of weight load to be added based on a physical strength of the user In further embodiments, the locking mechanism may be pivotally coupled to the one or more hanger arms 102-104, wherein the locking mechanism may be configured to allow pivotal movement of the one or more hanger arms 102-104 between a locked position and an unlocked position. Further, the weight of the one or more hanger arms 102-104 may be configured to enable the locking mechanism to change between the locked state and the unlocked state in response to a rotational force acting on the locking mechanism. Yet further, the weight of the one or more hanger arms 102-104 may be configured to maintain the one or more hanger arms 102-104, under the action of gravity, in a stationary position in relation to Earth while the rotational force acts on the locking mechanism. The rotational force causes a rotational displacement of the locking mechanism in relation to the one or more hanger arms 102-104, wherein the rotation displacement may change the locking mechanism between the locked state to the unlocked state.

In further embodiments, the locking mechanism may be slidably coupled to the hanger arm, wherein the locking mechanism may be configured to allow sliding movement of the hanger arm between a locked position and an unlocked position. Further, the weight of the hanger arm may be configured to enable the locking mechanism to change between the locked state and the unlocked state in response to a translatory force acting on the locking mechanism. The translatory force may cause a linear displacement of the locking mechanism in relation to the hanger arm, wherein the linear displacement changes the locking mechanism between the locked state and the unlocked state.

In further embodiments, the locking mechanism may include a latch and a catch. The latch may be in a restricted state when engaged with the catch, wherein the latch is in a free state when disengaged from the catch. One or both of the latch and the catch may be configured to remain in one of a resting state and an energized state. Further, one of the catch and the latch may include an energy storage means configured to provide the energized state, wherein a predetermined amount of force transitions one of the latch and the catch from the resting state to the energized state. For example, the energy storage means may be a spring. The engagement of the latch with the catch may occur upon one of the catch and the latch attaining the energized state. A hanger arm in the one or more hanger arms 102-104 may be rigidly coupled to one of the latch and the catch, wherein the predetermined amount of force is a reaction force resulting from the motion of the hanger arm in relation to the locking mechanism.

Further, the collapsible garment hanger 100 may include a hook 108 attached to the top of the housing structure 106. The hook 108 may be configured to support the collapsible garment hanger 100 onto a fixture (such as a rod or a rack). The hook 108 may be made from plastic or any other suitable material. Further, the hook 108 may be connected to the top of the housing structure 106, such that it is free to rotate, depending on how the user wishes to orient the collapsible garment hanger 100.

Moreover, the collapsible garment hanger 100 may include a release mechanism coupled to the locking mechanism. The release mechanism may be configured to receive a releasing force, wherein the releasing force may be configured to change the locking mechanism between the locked state and the unlocked state. In some embodiments, the release mechanism may be a button 110. Therefore, pressing the button 110 causes the locking mechanism to transition from the locked and the unlocked state and allow the hanger arms 102-104 to swing downward (as shown in FIG. 3-4). Further, the locking mechanism may transition between the locked and the unlocked state based on the motion. As a result, in some embodiments, the release mechanism may not be used in order to collapse the hanger arms.

Figure 5:
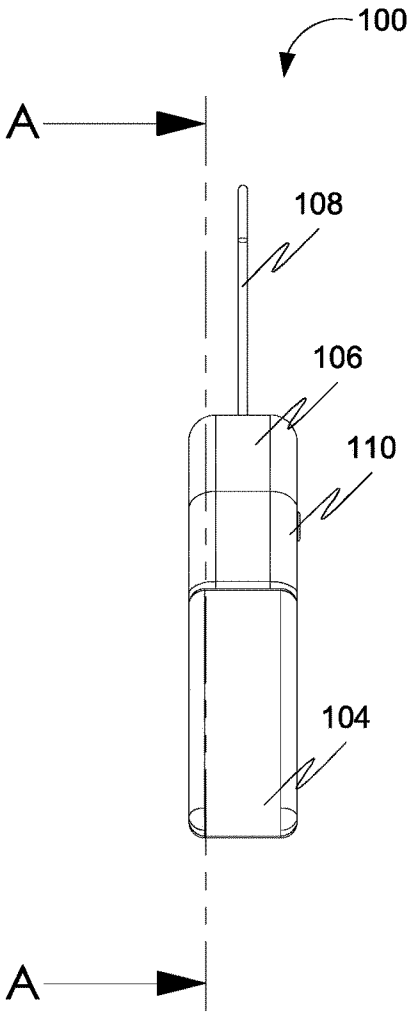
FIG. 5 is a left side view of the collapsible garment hanger of FIG. 1.
Figure 6:
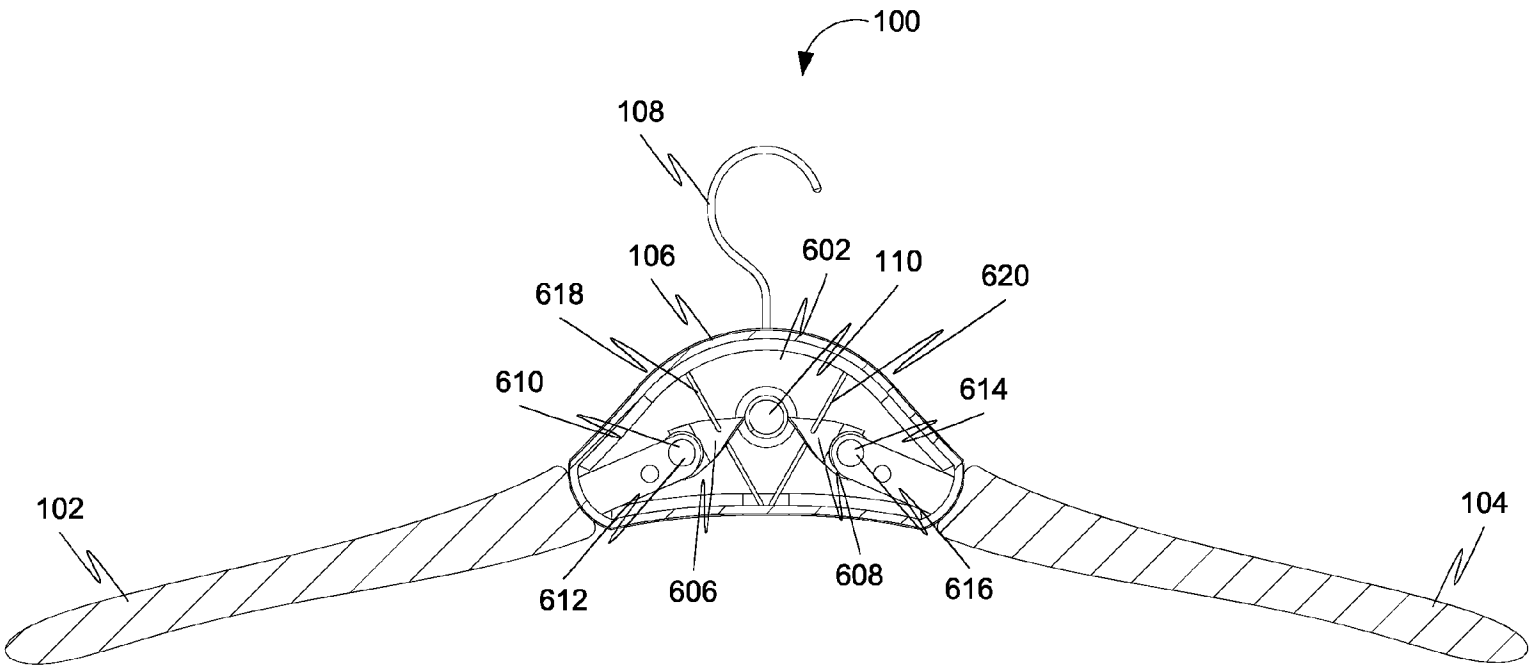
FIG. 6 is a rear cross-sectional view of the collapsible garment hanger taken along the line A-A of FIG. 5.
Figure 7:
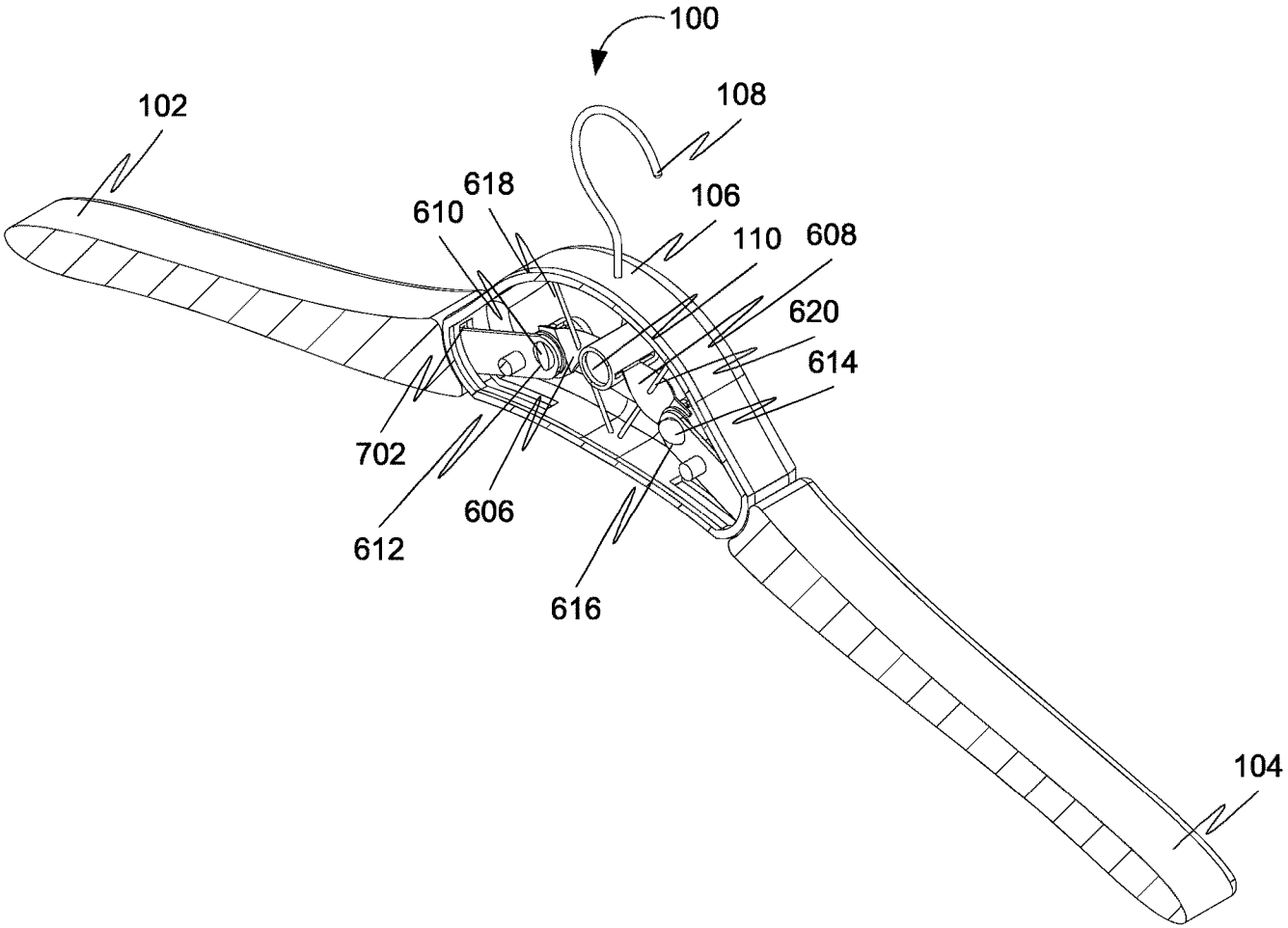
FIG. 7 is a rear isometric cross-sectional view of the collapsible garment hanger taken along the line A-A of FIG. 5.

FIG. 5 is a left side view of the collapsible garment hanger 100 showing a line A-A in which section views are taken and shown in FIGS. 6-7. FIG. 6 is a rear cross-sectional view of the collapsible garment hanger 100 taken along the line A-A of FIG. 5. FIG. 7 is a rear isometric cross-sectional view of the collapsible garment hanger 100 taken along the line A-A of FIG. 5. The one or more locking mechanisms may include a first locking mechanism and a second locking mechanism. The first locking mechanism may be coupled to the first hanger arm 102 and the second locking mechanism may be coupled to the second hanger arm 104, respectively. Further, the housing structure 106 may include a housing body 602 configured to provide a housing enclosure that may enclose each of the first locking mechanism and the second locking mechanism. The housing body 602 may be a hollow rounded triangle and may act as a cover for the components of each of the first locking mechanism and the second locking mechanism. The housing body 602 may be made of plastic or any other suitable material. Yet further, the housing structure 106 may include the button 110 configured to receive a pressing force. Moreover, the housing structure 106 may include a first lever 606 and a second lever 608. Each of the first lever 606 and the second lever 608 may be coupled to the button 110. The pressing force (applied on the button 110) may be transmittable to each of the first locking mechanism and the second locking mechanism through the first lever 606 and the second lever 608, respectively. The pressing force may cause each of the first locking mechanism and the second locking mechanism to change from the locked state to the unlocked state. Further, a front wall of the housing body 602 may include a recessed area configured to position the button 110 flush with the front wall.

Further, the housing structure 106 may include a first detent 610 corresponding to the first locking mechanism, wherein the first detent 610 may be configured to engage with a first arm hole 612 comprised in the first hanger arm 102. Similarly, the housing structure 106 may include a second detent 614 corresponding to the second locking mechanism, wherein the second detent 614 may be configured to engage with a second arm hole 616 comprised in the second hanger arm 104. The arm holes 612-616 may be circular in shape and they may be located on the end of the corresponding arm bracket.

Yet further, the housing structure 106 may include a first detent pin 808 configured to engage with the first detent 610. The first detent pin 808 is shown in FIG.

Figure 8:
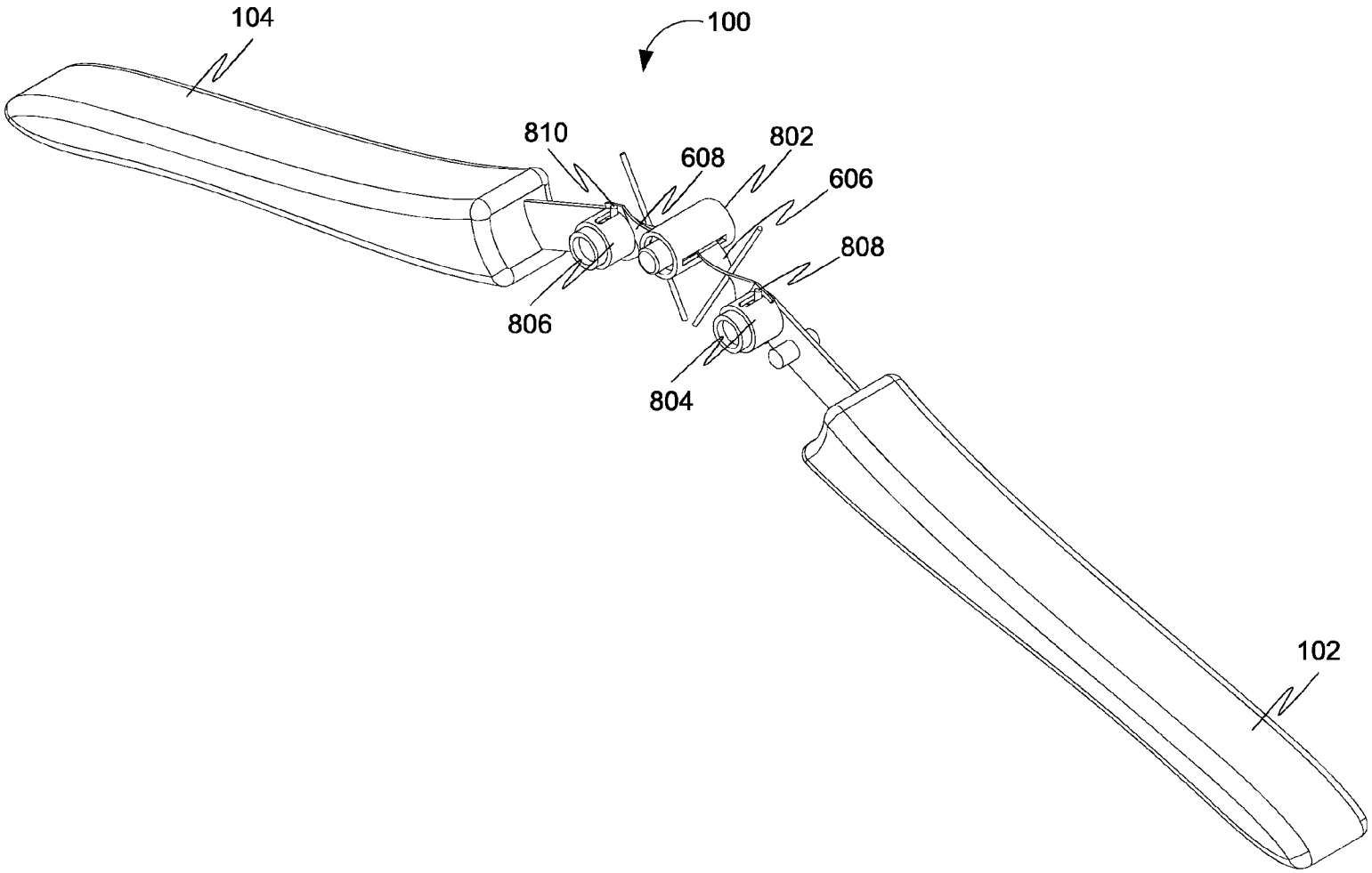
FIG. 8 is an isometric view of the collapsible garment hanger of FIG. 1 with a housing structure removed to show the components inside the housing structure.

8. Upon engagement, the first detent pin 808 may be configured to retract the first detent 610 resulting in the release of the first hanger arm 102 from the first detent 610. Similarly, the housing structure 106 may include a second detent pin 810 configured to engage with the second detent 614. The second detent pin 810 is shown in FIG. 8. Upon engagement, the second detent pin 810 may be configured to retract the second detent 614 resulting in the release of the second hanger arm 104 from the second detent 614. Further, a back face of each of the first detent 610 and the second detent 614 may be tapered. For example, the back face of each detent may taper towards the corresponding hanger arm. Further, each of the first detent pin 808 and the second detent pin 810 may fit vertically through a hole in the corresponding detent. Alternatively, each of the first detent pin 808 and the second detent pin 810 may be a part of the corresponding detent. Furthermore, each of the first detent pin 808 and the second detent pin 810 may have a diagonal, or horizontal orientation, or any other suitable orientation.

Yet further, the housing structure 106 may include lever pivots 618-620 configured to control the movement of the levers 606-608, respectively. The lever pivots 618-620 may be inserted through the center of the levers 606-608 respectively. In alternate embodiments, the lever pivots 618-620 may be inserted at any point on the levers 606-608 respectively. In alternate embodiments, the lever pivots 618-620 may be attached to the levers 606-608 respectively. The lever pivots 618-620 may be configured to restrict the movements of the respective levers 606-608 to rotations about the central axis of the respective lever pivots 618-620.

Each of the levers 606-608 include a lever body and two lever prongs. The body of each the first lever 606 and the second lever 608 may be a thin rectangular bar that has been twisted 90 degrees. Further, the lever prongs may be located on the end of the lever body that is not inserted into lever slots of a button casing 802 (shown in FIG. 8). The lever prongs may fit around corresponding detent casing (such as detent casings 804-806 shown in FIG. 8) and may be used to engage the corresponding detent pin, such that the corresponding detent may be pulled back to release the corresponding hanger arm. The first lever 606 and the second lever 608 are able to rotate about their center when the button 110 is pressed to interact with the first detent pin 808 and the second detent pin 810, respectively. In some embodiments, each of the levers 606-608 include a lever body and a rod on the lever end, with just one end going through the corresponding detent casing and accessing the corresponding detent.

In further embodiments, the housing structure 106 may include a first detent spring configured to maintain the first detent 610 in a resting state, wherein retraction of the first detent 610 causes a compression in the first detent spring. Similarly, the housing structure 106 may include a second detent spring configured to maintain the second detent 614 in a resting state, wherein retraction of the second detent 614 causes a compression in the second detent spring. Each detent spring fit may go around the corresponding detent inside a corresponding detent casing. Accordingly, the first and the second detent springs may be used to apply a constant force to the corresponding detents. Therefore, when the button 110 is pressed, it rotates the levers 606-608, which retract the detents 610-614 respectively, and compress the two detent springs. This allows the hanger arms 102-104 to swing downward freely. However, when the button 110 is released, the compressed detent springs push back on the detents 610-614 reversing the process and returning the button 110 to its original position. While locking the hanger arms 102-104, the detent springs may assist in forcing the detents 610-614 into the corresponding arm holes 612-616 to secure the hanger arms 102-104 in place.

Further, the collapsible garment hanger 100 may include a first arm slot 702 configured to allow the first arm hanger 102 to swing between a locked position and an unlocked position Similarly, a second arm slot (not shown) may be configured to allow the second arm hanger 104 to swing between a locked position and an unlocked position.

FIG. 8 is an isometric view of the collapsible garment hanger 100 with the housing structure 106 removed to show the components inside the housing structure 106. The collapsible garment hanger 100 may further include a button casing 802 configured to provide a guide for the button 110. The button casing 802 may be cylindrical in shape and it may extend from the inside front surface of the housing body 602. The button casing 802 may have two slots, one each for the first lever 606 and the second lever 608. The two slots may allow the button 110 to engage the levers 606-608 of the locking mechanism when the button 110 is pressed. The slots may be V-shaped or they may be shaped in any other suitable shape. Further, the collapsible garment hanger 100 may include a first detent casing 804 configured to guide movement of the first detent 610 and the collapsible garment hanger 100 may include a second detent casing 806 configured to guide movement of the second detent 614. Each of two detent casings 804-806 may be cylindrical in shape and may extend from the inside front surface of the housing body 602 and may be used to guide the respective detents of the locking mechanism by restricting their movement to the forward and backward directions. Further, each of the detent casings 804-806 may have a pin slot positioned on their top and bottom surfaces, which may be used to guide the detents 610-614, respectively, by preventing them from rotating. The first detent pin 808 and the second detent pin 810 may pass through the respective pin slots.

Figure 9:
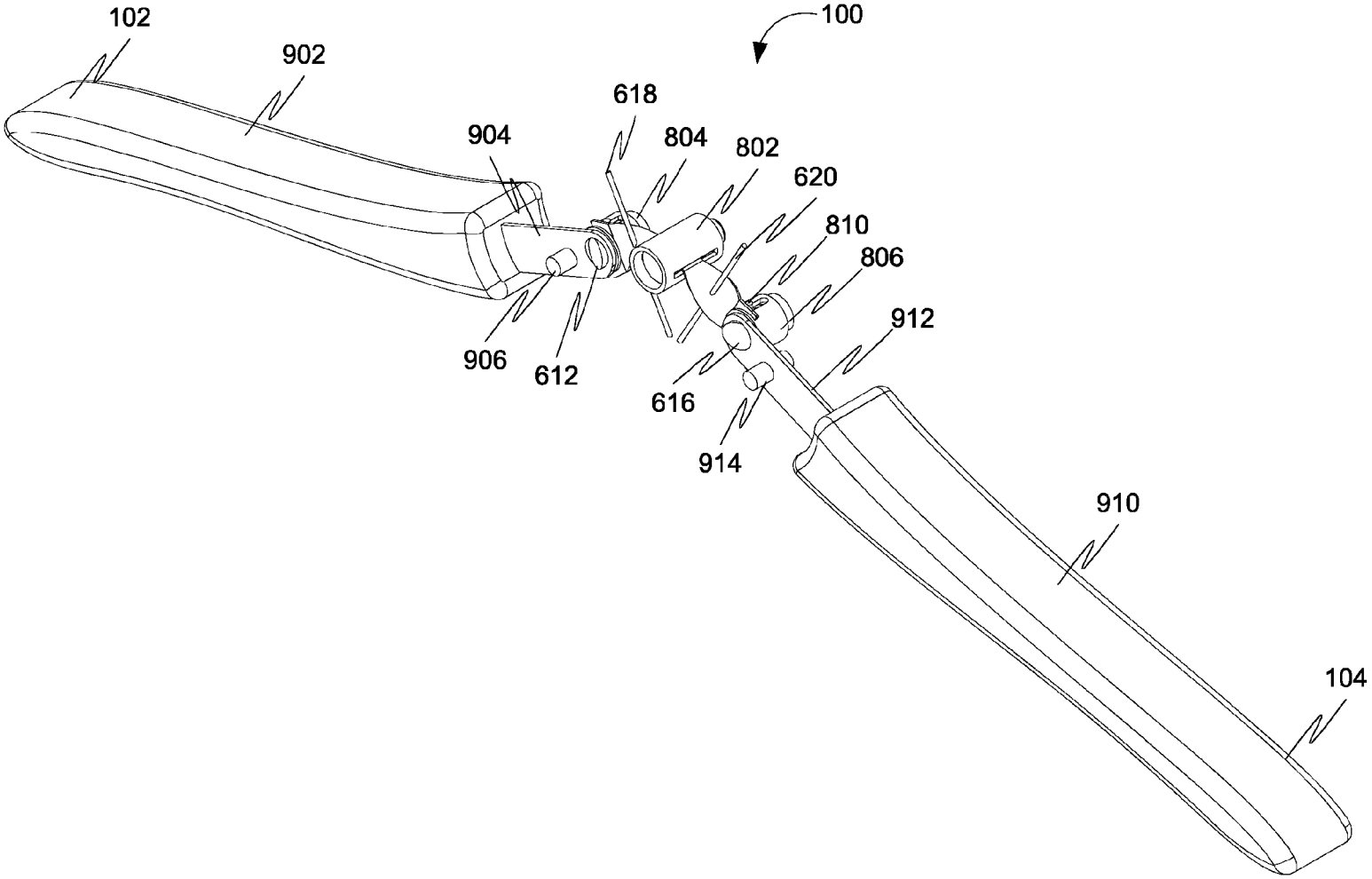
FIG. 9 is a rear isometric view of the collapsible garment hanger of FIG. 1 with a housing structure removed to show the components inside the housing structure.
Figure 10:
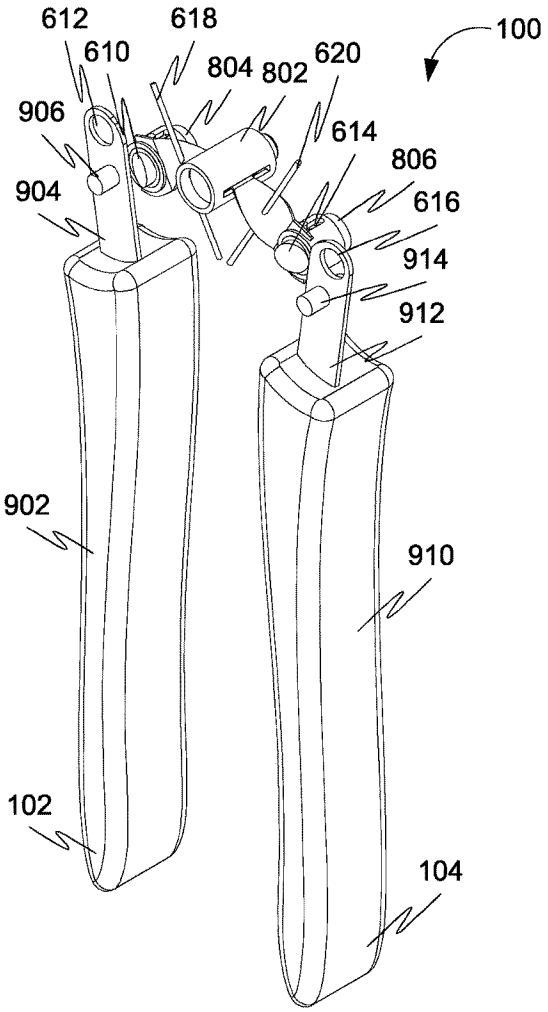
FIG. 10 is a rear isometric view of the collapsible garment hanger of FIG. 1 in the unlocked state with the housing structure removed to show the components inside the housing structure.

FIG. 9 is a rear isometric view of the collapsible garment hanger 100 with the housing structure 106 removed to show the components inside the housing structure 106. FIG. 10 is a rear isometric view of the collapsible garment hanger 100 in the unlocked state with the housing structure removed to show the components inside the housing structure. The first hanger arm 102 may include a first arm body 902, a first arm bracket 904 attached to the first arm body 902, a first arm pivot 906 and the first arm hole 612. The first arm body 902 may be configured to support a garment. The first arm bracket 904 may be configured to extend through the first arm slot 702. The first arm pivot 906 may be pivotally attached to the housing body 602. The second hanger arm 104 may include a second arm body 910, a second arm bracket 912, a second arm pivot 914 and the second arm hole 616. The second arm body 910 may be configured to support a garment. The second arm bracket 912 may be configured to extend through the second arm slot. The second arm pivot 914 may be pivotally attached to the housing body 602. The arm pivots 906-914 may extend normal to the corresponding arm bracket on both sides. The arm pivots 906-914 may be attached to the corresponding arm bracket. Alternatively, the arm pivots 906-914 may be part of the housing body 602 and inserted through the corresponding arm bracket. In further embodiments, both hanger arms 102-104 may share a single arm pivot.

Further, in some embodiments, a weight of each of the first hanger arm 102 and the second hanger arm 104 may be configured to enable the locking mechanism to change from the unlocked state to the locked state in response to a motion of the hanger arm in relation to the locking mechanism. The motion is a result of one of a rotation of the housing structure 106, a jolting of the housing structure 106 and a flinging of the housing structure 106. Further, the rotation of the housing structure 106 by at least 180 degrees may cause each of the first hanger arm 102 and the second hanger arm 104 to move from the unlocked state to the locked state.

DETAIL DESCRIPTIONS OF THE EMBODIMENTS

A collapsible garment hanger capable of being operated by one hand is provided. The collapsible garment hanger may include at least one hanger arm. Further, a hanger arm may include an elongated body. Further, the collapsible garment hanger may include at least one locking mechanism coupled to the at least one hanger arm. Further, a locking mechanism coupled to a hanger arm may be configured to remain in one of a locked state and an unlocked state. Further, a weight of one or more of the hanger arm and the locking mechanism may be configured to enable the locking mechanism to change between a locked state and an unlocked state in response to a motion of the hanger arm in relation to the locking mechanism. Further, the collapsible garment hanger may include a housing structure coupled to the at least one locking mechanism.

In some embodiments, the locking mechanism may be pivotally coupled to the hanger arm. Further, the locking mechanism may be configured to allow pivotal movement of the hanger arm between a locked position and an unlocked position. Further, the weight of the hanger arm may be configured to enable the locking mechanism to change between the locked state and the unlocked state in response to a rotational force acting on the locking mechanism. Further, the weight of the hanger arm may be configured to maintain the hanger arm, under the action of gravity, in a stationary position in relation to Earth while the rotational force acts on the locking mechanism. Further, the rotational force causes a rotational displacement of the locking mechanism in relation to the hanger arm. Further, the rotation displacement changes the locking mechanism between the locked state and the unlocked state.

In some embodiments, the locking mechanism may be slidably coupled to the hanger arm. Further, the locking mechanism may be configured to allow sliding movement of the hanger arm between a locked position and an unlocked position. Further, the weight of the hanger arm may be configured to enable the locking mechanism to change between the locked state and the unlocked state in response to a translatory force acting on the locking mechanism. Further, the translatory force causes a linear displacement of the locking mechanism in relation to the hanger arm. Further, the linear displacement changes the locking mechanism between the locked state and the unlocked state.

In some embodiments, the motion may include an abrupt motion.

In some embodiments, the motion may include one or more of a linear motion and a rotatory motion.

In some embodiments, the hanger arm may include at least one weight load disposed proximal to a first end of the elongated body. Further, the locking mechanism may be coupled to the hanger arm at a second end of the elongated body.

In some embodiments, the hanger arm may include at least one weight slot configured to receive the at least one weight load.

In some embodiments, the locking mechanism may include a latch and a catch. Further, the latch may be in a restricted state when engaged with the latch. Further, the latch may be in a free state when disengaged from the catch. Further, one or more of the latch and the catch may be configured to remain in one of a resting state and an energized state. Further, one of the catch and the latch may include an energy storage means configured to provide the energized state. Further, a predetermined amount of force transitions one of the latch and the catch from the resting state to the energized state. Further, engagement of the latch with the catch occurs upon one of the catch and the latch attaining the energized state. Further, the hanger arm may be rigidly coupled to one of the latch and the catch. Further, the predetermined amount of force may be a reaction force resulting from the motion of the hanger arm in relation to the locking mechanism.

In some embodiments, the collapsible garment hanger may further include a hook attached to the housing structure. Further, the hook may be configured to support the collapsible garment hanger onto a fixture.

In some embodiments, the collapsible garment hanger may further include a release mechanism coupled to the locking mechanism. Further, the release mechanism may be configured to receive a releasing force. Further, the releasing force may be configured to change the locking mechanism between the locked state and the unlocked state.

In some embodiments, the at least one hanger arm may include a first hanger arm and a second hanger arm, the at least one locking mechanism may include a first locking mechanism and a second locking mechanism. Further, the first locking mechanism may be coupled to the first hanger arm. Further, the second locking mechanism may be coupled to the second hanger arm.

In some embodiments, the housing structure may include a housing body configured to provide a housing enclosure. Further, the housing enclosure may enclose each of the first locking mechanism and the second locking mechanism, a button configured to receive a pressing force, a first lever and a second lever. Further, each of the first lever and the second lever may be coupled to the button. Further, the pressing force may be transmittable to each of the first locking mechanism and the second locking mechanism through the first lever and the second lever respectively. Further, the pressing force causes each of the first locking mechanism and the second locking mechanism to change from the locked state to the unlocked state. Further, the first detent may be configured to engage with a first arm hole comprised in the first hanger arm and a second detent corresponding to the second locking mechanism. Further, the second detent may be configured to engage with a second arm hole comprised in the second hanger arm; a first detent pin configured to engage with the first detent. Further, upon engagement, the first detent pin may be configured to retract the first detent resulting in release of the first hanger arm from the first detent; a second detent pin configured to engage with the second detent. Further, upon engagement, the second detent pin may be configured to retract the second detent resulting in release of the second hanger arm from the second detent; a first detent spring configured to maintain the first detent in a resting state. Further, retraction of the first detent causes a compression in the first detent spring; a second detent spring configured to maintain the second detent in a resting state. Further, retraction of the second detent causes a compression in the second detent spring;

In some embodiments, the collapsible garment hanger may further include a button casing configured to provide a guide for the button, a first detent casing configured to guide movement of the first detent and a second detent casing configured to guide movement of the second detent.

In some embodiments, the collapsible garment hanger may further include a first arm slot configured to allow the first arm hanger to swing between a locked position and an unlocked position and a second arm slot configured to allow the second arm hanger to swing between a locked position and an unlocked position.

In some embodiments, the first hanger arm may include a first arm body, a first arm bracket attached to the first arm body, a first arm pivot and the first arm hole. Further, the first arm body may be configured to support a garment. Further, the first arm bracket may be configured to extend through the first arm slot. Further, the first arm pivot may be pivotally attached to the housing body. Further, the second hanger arm may include a second arm body, a second arm bracket, a second arm pivot and the second arm hole. Further, the second arm body may be configured to support a garment. Further, the second arm bracket may be configured to extend through the second arm slot. Further, the second arm pivot may be pivotally attached to the housing body.

In some embodiments, a front wall of the housing body may include a recessed area configured to position the button flush with the front wall.

In some embodiments, a back face of each of the first detent and the second detent may be tapered.

In some embodiments, an exterior of the housing structure may include of a non-slip material.

In some embodiments, a weight of each of the first hanger arm and the second hanger arm may be configured to enable the locking mechanism to change from the unlocked state to the locked state in response to a motion of the hanger arm in relation to the locking mechanism. Further, the motion may be a result of one or more of a rotation of the housing structure, a jolting of the housing structure and a flinging of the housing structure.

In some embodiments, rotation of the housing structure by at least 180 degrees causes each of the first hanger arm and the second hanger arm to move from the unlocked state to the locked state.

Although the invention has been explained in relation to its preferred embodiment, it is to be understood that many other possible modifications and variations can be made without departing from the spirit and scope of the invention.

I claim:

1. A collapsible garment hanger capable of being operated by one hand, the collapsible garment hanger comprising:

at least one hanger arm, wherein a hanger arm comprises an elongated body;

at least one locking mechanism coupled to the at least one hanger arm, wherein the at least one locking mechanism is pivotally coupled to the at least one hanger arm in order to allow pivotal movement of the at least one hanger arm between a locked position and an unlocked position, wherein a locking mechanism coupled to a hanger arm is configured to remain in one of a locked state corresponding to the locked position of the at least one hanger arm and an unlocked state corresponding to the unlocked position of the at least one hanger arm, wherein a weight of at least one of the hanger arm and the locking mechanism is configured to enable the locking mechanism to change to a locked state from an unlocked state in response to a motion of the hanger arm in relation to the locking mechanism, wherein the hanger arm comprises at least one weight load disposed proximal to a first end of the elongated body, wherein the locking mechanism is coupled to the hanger arm at a second end of the elongated body; and a housing structure coupled to the at least one locking mechanism, wherein the motion of the hanger arm is a result of a force provided on the housing structure and inertia of the at least one hanger.

2. The collapsible garment hanger of claim 1, wherein the weight of the hanger arm is configured to enable the locking mechanism to change to the locked state from the unlocked state in response to a rotational force acting on the locking mechanism, wherein the weight of the hanger arm is configured to maintain the hanger arm in a stationary position while the rotational force acts on the locking mechanism, wherein the rotational force causes a rotational displacement of the locking mechanism in relation to the hanger arm, wherein the rotation displacement changes the locking mechanism to the locked state from the unlocked state.

3. The collapsible garment hanger of claim 1, wherein the motion comprises an abrupt motion.

4. The collapsible garment hanger of claim 1, wherein the motion comprises at least one of a linear motion and a rotatory motion.

5. The collapsible garment hanger of claim 1, the locking mechanism comprises a latch and a catch, wherein the latch is in a restricted state when engaged with the catch, wherein the latch is in a free state when disengaged from the catch, wherein at least one of the latch and the catch is configured to remain in one of a resting state and an energized state, wherein one of the catch and the latch comprises an energy storage means configured to provide the energized state, wherein a predetermined amount of force transitions one of the latch and the catch from the resting state to the energized state, wherein engagement of the latch with the catch occurs upon one of the catch and the latch attaining the energized state, wherein the hanger arm is rigidly coupled to one of the latch and the catch, wherein the predetermined amount of force is a reaction force resulting from the motion of the hanger arm in relation to the locking mechanism.

6. The collapsible garment hanger of claim 1 further comprising a hook attached to the housing structure, wherein the hook is configured to support the collapsible garment hanger onto a fixture.

7. The collapsible garment hanger of claim 1 further comprising a release mechanism coupled with the locking mechanism, wherein the release mechanism is configured to receive a releasing force, wherein the releasing force is configured to change the locking mechanism from the locked state to the unlocked state.

8. The collapsible garment hanger of claim 1, wherein the at least one hanger arm comprises a first hanger arm and a second hanger arm, the at least one locking mechanism comprises a first locking mechanism and a second locking mechanism, wherein the first locking mechanism is coupled to the first hanger arm, wherein the second locking mechanism is coupled to the second hanger arm.

9. The collapsible garment hanger of claim 8, wherein the housing structure comprises:

a housing body configured to provide a housing enclosure, wherein the housing enclosure encloses each of the first locking mechanism and the second locking mechanism;

a button configured to receive a pressing force;

a first lever and a second lever, wherein each of the first lever and the second lever are coupled to the button, wherein the pressing force is transmittable to each of the first locking mechanism and the second locking mechanism through the first lever and the second lever respectively, wherein the pressing force causes each of the first locking mechanism and the second locking mechanism to change from the locked state to the unlocked state;

a first detent corresponding to the first locking mechanism, wherein the first detent is configured to engage with a first arm hole comprised in the first hanger arm;

a second detent corresponding to the second locking mechanism, wherein the second detent is configured to engage with a second arm hole comprised in the second hanger arm;

a first detent pin configured to engage with the first detent, wherein upon engagement, the first detent pin is configured to retract the first detent resulting in release of the first hanger arm from the first detent;

a second detent pin configured to engage with the second detent, wherein upon engagement, the second detent pin is configured to retract the second detent resulting in release of the second hanger arm from the second detent;

a first detent spring configured to maintain the first detent in a resting state, wherein retraction of the first detent causes a compression in the first detent spring;

a second detent spring configured to maintain the second detent in a resting state, wherein retraction of the second detent causes a compression in the second detent spring.

10. The collapsible garment hanger of claim 9 further comprising:

a button casing configured to provide a guide for the button;

a first detent casing configured to guide movement of the first detent; and a second detent casing configured to guide movement of the second detent.

11. The collapsible garment hanger of claim 9 further comprising:

a first arm slot configured to allow the first arm hanger to swing between a locked position and an unlocked position; and a second arm slot configured to allow the second arm hanger to swing between a locked position and an unlocked position.

12. The collapsible garment hanger of claim 11, wherein the first hanger arm comprises a first arm body, a first arm bracket attached to the first arm body, a first arm pivot and the first arm hole, wherein the first arm body is configured to support a garment, wherein the first arm bracket is configured to extend through the first arm slot, wherein the first arm pivot is pivotally attached to the housing body, wherein the second hanger arm comprises a second arm body, a second arm bracket, a second arm pivot and the second arm hole, wherein the second arm body is configured to support a garment, wherein the second arm bracket is configured to extend through the second arm slot, wherein the second arm pivot is pivotally attached to the housing body.

13. The collapsible garment hanger of claim 9, wherein a front wall of the housing body comprises a recessed area configured to position the button flush with the front wall.

14. The collapsible garment hanger of claim 9, wherein each of the first detent and the second detent is tapered.

15. The collapsible garment hanger of claim 9, wherein an exterior of the housing structure comprises a non-slip material.

16. The collapsible garment hanger of claim 9, wherein a weight of each of the first hanger arm and the second hanger arm is configured to enable the locking mechanism to change from the unlocked state to the locked state in response to a motion of the hanger arm in relation to the locking mechanism, wherein the motion is a result of at least one of a rotation of the housing structure, a jolting of the housing structure and a flinging of the housing structure.

17. The collapsible garment hanger of claim 16, wherein rotation of the housing structure by at least 180 degrees causes each of the first hanger arm and the second hanger arm to move from the unlocked state to the locked state.

* * * * *